US005791464A

United States Patent [19]

Galbierz et al.

[11] Patent Number: 5,791,464

[45] Date of Patent: Aug. 11, 1998

[54] COVER FOR CONTAINERS IN MULTIPACK CARRIERS

[76] Inventors: Jerome Joseph Galbierz, 11 Berry Rd. Park, St. Louis, Mo. 63122; Michael Louis Reinig, 16105 Wilson Manor Dr., Chesterfield, Mo. 63005; Richard Ernest Wendt, Jr., 37 Topping La., Des Peres, Mo. 63131

[21] Appl. No.: 819,715

[22] Filed: Mar. 17, 1997

[51] Int. Cl.[6] ..... B65D 75/00

[52] U.S. Cl. ..... 206/151; 206/145; 206/158

[58] Field of Search ..... 206/139, 145, 206/149, 151, 158; 294/87.2

[56] References Cited

U.S. PATENT DOCUMENTS

| | | | |
|---|---|---|---|
| 3,046,711 | 7/1962 | Harrison | 206/158 |
| 3,784,002 | 1/1974 | Owen | 206/158 |
| 5,186,321 | 2/1993 | Fadus | 206/151 |
| 5,188,225 | 2/1993 | Jorba | 206/145 |
| 5,487,464 | 1/1996 | Galbierz et al. | 206/149 |
| 5,551,566 | 9/1996 | Sutherland | 206/151 |
| 5,573,111 | 11/1996 | Gordon et al. | 206/151 |

*Primary Examiner*—David T. Fidei

[57] ABSTRACT

A cover for tops of flanged containers held in planar paperboard carriers excludes contamination from surfaces which will contact the contents when they are poured out or a consumer's mouth will contact. The cover is formed from multilaterally-stretchable paper and is applied to the carrier in two different ways to create two versions of the embodiment of the invention. In Version I, a sheet of multilaterally-stretchable paper overlies the planar carrier body and is attached to the carrier at the periphery of the cover and elsewhere as required by the configuration of the carrier. When containers are inserted in the carrier, they raise small tents by stretching the paper cover and the container tops lie protected between the carrier body and the cover sheet. In Version II, a sheet of multilaterally-stretchable paper underlies the planar carrier body and is attached to the carrier where required by the configuration of the carrier. When containers are inserted in the carrier, the container tops are enveloped by the cover, which is held in place by the container-retention means of the carrier.

11 Claims, 3 Drawing Sheets

COVER FOR CONTAINERS IN MULTIPACK CARRIERS

BACKGROUND OF THE INVENTION

1. Field of the Invention

This invention relates in general to carriers for multiples of flanged containers, more particularly to covers by which the tops of such containers may be shielded from contamination by dust, liquid droplets and spray, insects and vermin during storage and distribution, and specifically to such covers adapted to planar paperboard multipack carriers without sacrifice of the biodegradability inherent in products made of paperboard and the recycleability of paper products unmixed with plastic.

2. Background Information

A drawback of multipack beverage carriers made according to the teachings of Poupitch in U.S. Pat. No. 3,086,651 for plastic bridles or Galbierz in U.S. Pat. No. 5,125,506 for planar paperboard carriers is that the tops of the containers (usually cans) are exposed during distribution to contamination by dust, insects, and liquid droplets. It is accordingly the principal object of this invention to provide an economical sanitary cover to be used in conjunction with planar paperboard carriers to protect the tops of containers held in such carriers from contamination of the sorts and severity encountered in storage and distribution.

The inventors are aware of the following U.S. Patents which have cleantop features, whether claimed or not:

| U.S. Pat. No. | Inventor/Assignee | Issued |
|---|---|---|
| D329,603 | Barrett | 22-Sep-92 |
| 1,974,711 | Gebhard | 25-Sep-34 |
| 3,038,600 | Powell | 12-Jun-62 |
| 3,137,109 | Rapata/ITW | 16-Jun-64 |
| 3,242,631 | Whiteford/R. A. Jones | 29-Mar-66 |
| 3,281,180 | Spery | 25-Oct-66 |
| 3,317,234 | Burford/DeShazor | 02-May-67 |
| 3,331,500 | Poupitch/ITW | 18-Jul-67 |
| 3,488,911 | Poupitch/ITW | 13-Jan-70 |
| 3,494,098 | Sternau/W. R. Grace & Co | 10-Feb-70 |
| 3,601,253 | Poupitch/ITW | 24-Aug-71 |
| 3,601,439 | Poupitch/ITW | 24-Aug-71 |
| 3,711,145 | Rapata/ITW | 16-Jan-73 |
| 4,281,502 | Bonkowski/Forma-Pack | 04-Aug-81 |
| 4,688,367 | Bonkowski/Forma-Pack | 25-Aug-87 |
| 4,911,288 | Dantoin | 27-Mar-90 |
| 4,974,726 | Klygis et al/ITW | 04-Dec-90 |
| 5,088,269 | Thelen/Nigrelli Systems | 18-Feb-92 |
| 5,099,632 | Klygis et al/ITW | 31-Mar-92 |
| 5,103,971 | Schuster/ Riverwood | 14-Apr-92 |
| 5,123,228 | Bonkowski et al/Forma-Pack | 23-Jan-92 |
| 5,234,102 | Schuster et al/Riverwood | 10-Aug-93 |
| 5,237,796 | Bonkowski/Forma-Pack | 24-Aug-93 |
| 5,285,892 | Adami/Sweetheart Cup | 14-Feb-94 |
| 5,310,051 | Sutherland/Riverwood | 10-May-94 |
| 5,562,205 | Diaz | 12-Feb-96 |

Most of the inventors cited have resorted to plastic films for protective coverage, as in Bonkowski 4,281,502, Burford 3,371,234 and Rapata 3,137,109. These are sui generis and unrelated to existing carriers in actual use. By contrast, particular targets of the present invention are products such as beer and soft drinks distributed in cans packaged at high speed by specialized machinery which represents a major investment. It is therefore another object of this invention to make cleantop covers for paperboard carriers to render the combination applicable by machines already tooled for those carriers without radical modification.

One virtue of paperboard carriers is that they can be made biodegradable, in contrast to most plastic carriers, as well as recycleable. It is accordingly an additional object of this invention to add the clean-top function to paperboard carriers by using biodegradable auxiliary parts which can be recycled directly with the carrier.

SUMMARY OF THE INVENTION

The present invention exists in two practical versions. In Version I, a sheet of stretchable paper material overlies the paper-board carrier and is attached to the carrier at the periphery and preferably around any holes for handles, finger grips, etc. When containers enter the carrier from the bottom, their tops are protected by little tents from contamination from above and substantially protected by the container retaining fingers or similar feature from contamination from below. In Version II, a sheet of stretchable paper material is attached at various points to the underside of the paperboard carrier. When containers enter the carrier from below, the stretchable material is carried up through the container engaging apertures and wraps the tops of the containers for a high degree of protection.

A carrier similar to Version I with plastic specified as the stretchable sheet is shown by Burford in U.S. Pat. No. 3,317,234, and carriers similar to both Versions I and II are shown by Rapata in U.S. Pat. No. 3,137,109 with polyethylene specified. If the innovation disclosed here amounted solely to a substitution of material(s) with the same properties, it would be obvious, but there are some subtle shortcomings in use of plastic as prescribed by Burford and Rapata overcome by the present invention and the material chosen for covers.

When material described as plastic is deformed, it retains a large part of that deformation when the deforming force is relaxed and typically does not gain in elastic modulus (strength) by being so deformed. The result is that deformations prescribed in Burford and Rapata do not take place over the entire stressed material but are concentrated wherever the initial stress is greatest. This defeats the scenario described in those patents and may explain the absence from the market of cleantop carriers made according to their teachings. In contrast to plastic films, there are paper products made according to the teachings of Kemp in U.S. Pat. No. 2,008,181 and improvements thereon with the property characterized by Kemp as multilaterial stretchability and elsewhere as biaxial stretchability. Paper with this capability may be found referred to as cross-creped in reference to the production process underlying the Kemp patents. When such paper is stretched in any direction, it yields readily to a small extent but thereafter exhibits the full strength of the paper from which it was made.

When carriers filled with containers such as beer or soft drink cans are stacked, the bottoms of cans in one layer nest in the tops of the next inferior layer, and material of the cleantop cover is placed in lateral tension and normal compression over a short radial distance inside the can top. Here the toughness of paper makes a significant difference in durability under repeated stress of vibration such as would be encountered in the common practice of shipping tall stacks of carriers.

BRIEF DESCRIPTION OF THE DRAWINGS

In the accompanying drawings, which form part of the specification and wherein like numerals and letters refer to like parts wherever they occur.

DESCRIPTION OF THE PREFERRED EMBODIMENTS

Figure 1:
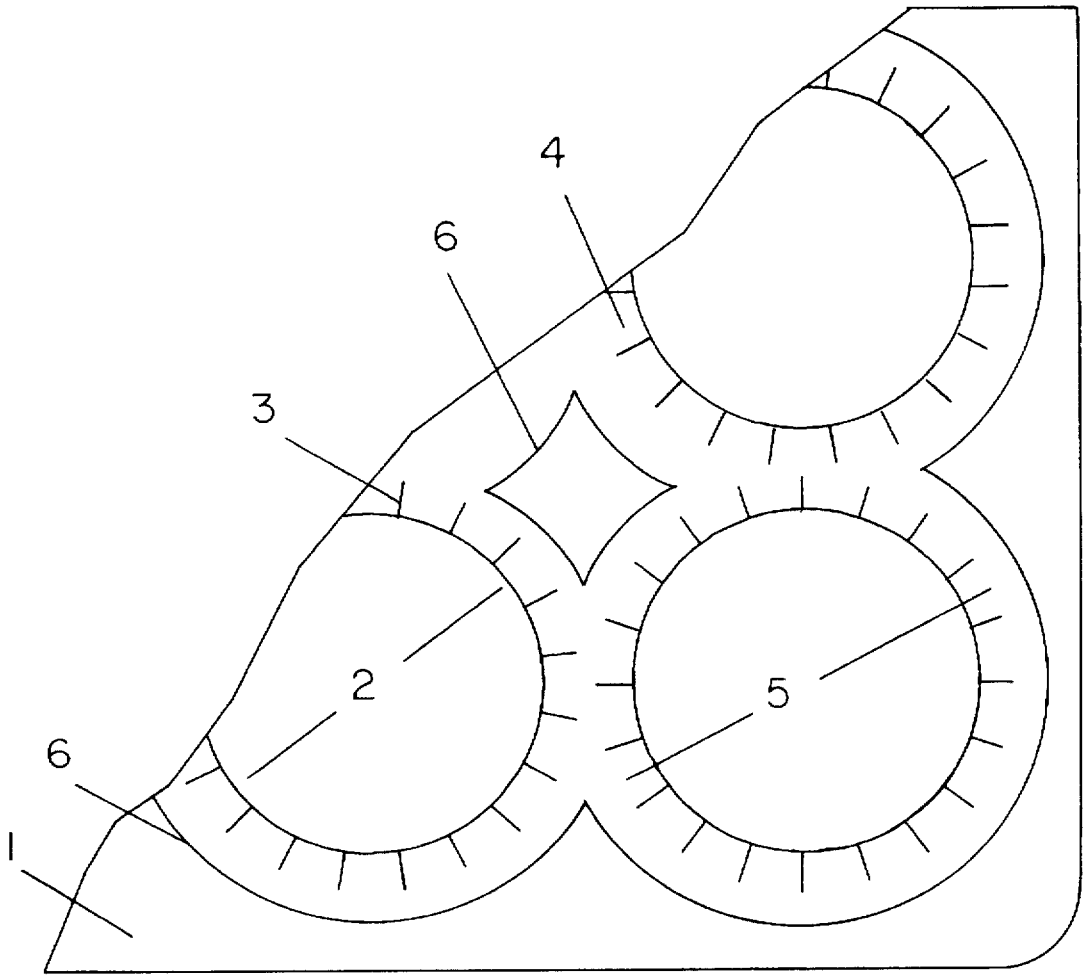
FIG. 1 is a partial plan view of a generalized planar paperboard carrier for flanged containers included to make clear the references to parts therof in connection with use of cleantop covers on such planar paperboard carriers.

Referring now to the drawings, a generic planar paperboard carrier for which the present invention provides cleantop covers is shown in FIG. 1, where the paperboard body 1 is pierced by an array of container retaining apertures 2, each surrounded by radial slits 3 extending outward from the apertures to form a ring of radial fingers 4 with root diameter 5 . The fingers may be strengthened by various schemes of embossment suggested by the patterns 6 in FIG. 1.

Figure 2:
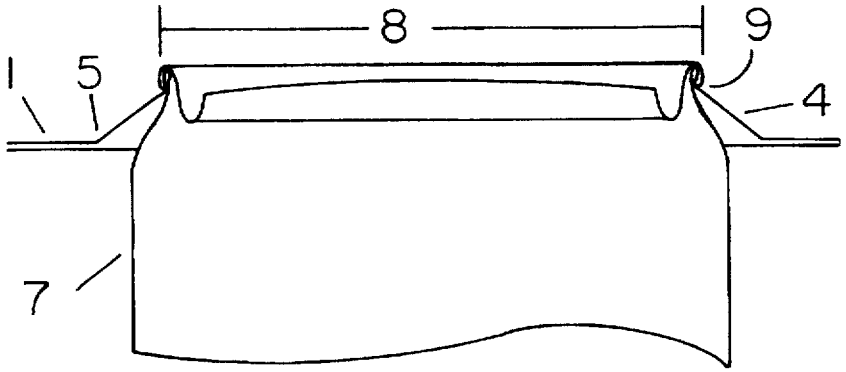
FIG. 2 is a partial transverse sectional view of a beverage can not shown in FIG. 1 engaged by a planar paperboard carrier such as is shown in FIG. 1.

Review of the art which the present invention advances is completed with reference to FIG. 2, in which a beverage can 7 represents a general flanged container whose top diameter 8 is larger than the diameter of aperture 2 but smaller than the root diameter 5 of the fingers 4. When a container is thrust into an aperture, the fingers flex at their roots to let the maximum diameter 8 of the container top pass but spring back into the chime 9 below the top to hold the container in the carrier.

As indicated above, the present invention takes two forms of embodiment: Version I, in which a cover material overlies the carrier top from which the top of a container protrudes when engaged by the carrier, and Version II, in which a cover material underlies the carrier bottom through which a container enters an aperture of the carrier. In both versions, opacity of multilaterally stretchable paper preferred as the cover material allows for inclusion of coupons, game pieces, or small premiums while discouraging pilferage.

Figure 3:
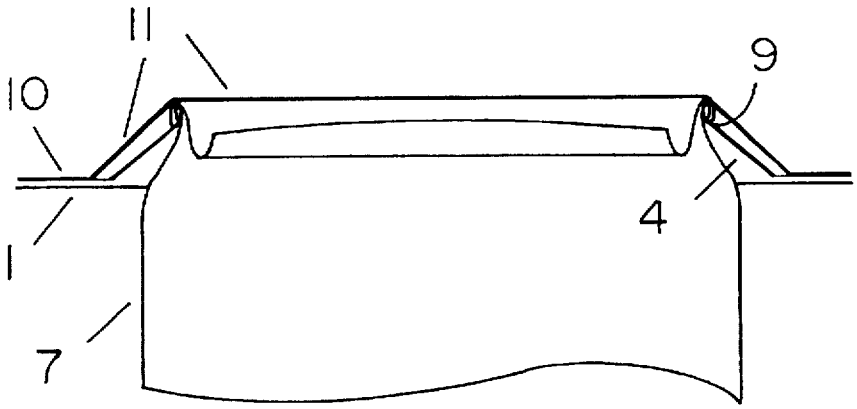
FIG. 3 is a partial transverse sectional view of a beverage can engaged in a planar paperboard carrier and protected by a cleantop cover according to Version I of the present invention.

Version I is illustrated in FIG. 3, where a sheet of multilaterally stretchable paper 10 is attached to the top face of the carrier body 1 at various points, typically around the roots of the retaining fingers 4, and around any other apertures provided in the carrier body 1 to accommodate finger grips, handles, or other accessories. Insertion of a container 7 in an aperture 2 stretches sheet 10 until fingers 4 are seated under the chime 9 of the container, and the resulting tent or bubble 11 in sheet 10 covers the container top. The inventors have found that adhesive applied in straight lines along the four edges of the carrier and between any aperture and its neighboring apertures yields adequate adherence between the carrier body and the cover sheet with simplification of the application process.

Version I would be chosen when an extended area is desired for graphics, which the inventors have found are not seriously distorted by the stretching, or when the addition of a cleantop feature to an existing carrier design is desired.

Figure 4:
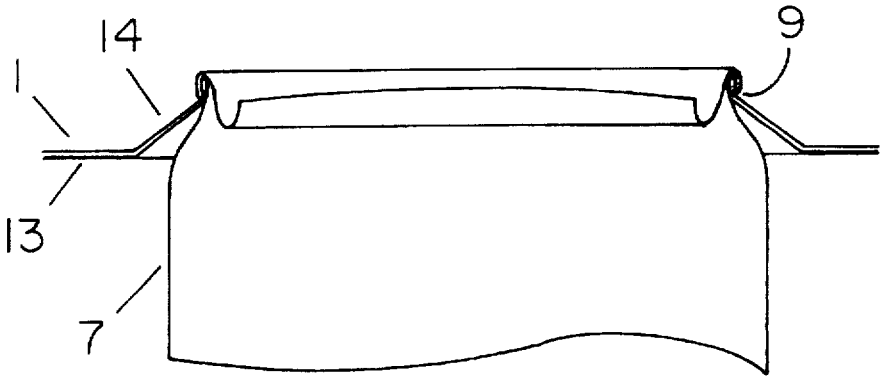
FIG. 4 is a partial transverse sectional view of a soft drink can engaged in a planar paperboard carrier and protected by a cleantop cover according to Version II of the present invention.

Version II is illustrated in FIG. 4, where a sheet of multilaterally stretchable paper 13 is attached to the lower face of the carrier body 1 at various points, typically around the carrier periphery. Insertion of a container stretches sheet 13 and carries the stretched section through the aperture 2 until fingers 14 engage chime 9 of the container through cover sheet 13 . Much less connection of the cover sheet 13 to the carrier body 1 is required in Version II than of sheet 10 in Version I, since in Version II a container is entirely enveloped by the cover sheet. This arrangement requires fingers 14 to be stiffer than fingers 4 in Version I in order to maintain engagement with chime 9 through cover sheet 13 . The requisite stiffness is most economically obtained by making the fingers 14 shorter and wider (therefore fewer) than in a carrier for use in Version I or without a cover.

Figure 5:
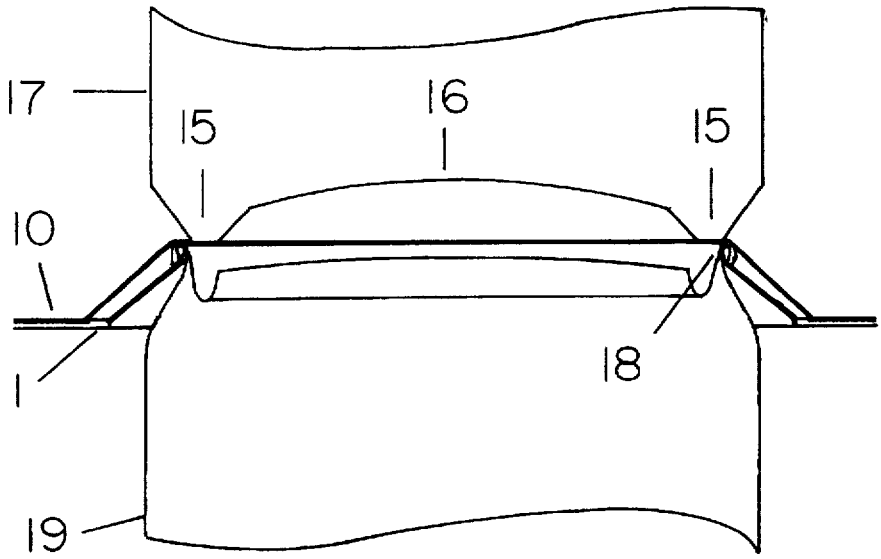
FIG. 5 is a partial transverse sectional drawing of two soft drink cans stacked with the inferior can engaged in a cleantop carrier according to Version I of the present invention.

The ability of cleantop covers made according to the present invention to withstand stacking of beverage cans one upon another as in large-scale shipment is illustrated most clearly with Version I as shown in FIG. 5, where the ring 15 which supports the domed bottom 16 of the superior can 17 is nested in the top 18 of inferior can 19. Sheet 10 which covers the top of can 19 is in normal compression only, having yielded sufficiently to lateral tension that there is no tensile stress to initiate tearing. This feature may eliminate the need for corrugated paper trays between layers and gives better interlocking between layers for more stable stacks.

For clarity of explanation, the foregoing descriptions have been made in a specific context, which is not intended to be limiting in the use of the innovations disclosed. All others in the spirit of the invention, such as kraft paper randomly wrinkled in two directions to provide extensibility, are included in its scope.

We claim the following innovations as our invention:

1. A cover for tops of flanged containers held in apertures in a planar paperboard carrier by radial fingers surrounding said apertures said carrier having a bottom face through which said containers enter said carrier and a top face from which said tops of said containers protrude from the plane of said carrier said cover being made of multilaterally-stretchable paper capable of stretching along two distinct axes said paper being attached to said top face of said carrier so that said tops of said containers thrust through said carrier from the bottom will be covered above by said multilaterally-stretchable paper and retained in said carrier and covered below by said radial fingers bearing on the chimes under said tops of said containers.

2. A cover for tops of containers as in claim 1 wherein the sheet of multilaterally-stretchable paper is attached to the top face of the carrier over the entirety of said top face except for the radial fingers which retain said containers in said carrier.

3. A cover for tops of containers as in claim 1 wherein the sheet of multilaterally-stretchable paper has been during its production or later rendered moisture resistant.

4. A cover for tops of containers as in claim 1 wherein the sheet of multilaterally-stretchable paper is firmly attached to the top face of the carrier but only along the periphery of said carrier and of auxiliary holes if any in said carrier.

5. A cover for tops of containers as in claim 1 wherein the sheet of multilaterally-stretchable paper is firmly attached to the top face of the carrier along the periphery of said carrier and of auxiliary holes if any in said carrier and at selected points of said top face of said carrier to maintain a smooth appearance of said cover.

6. A cover for tops of containers as in claim 1 wherein the planar carrier has attached or hingedly connected thereto flaps, carrying handles, or other appurtanences which may not lie in the plane of said carrier.

7. A cover for tops of flanged containers held in apertures in a planar paperboard carrier by radial fingers surrounding said apertures said carrier having a bottom face through which said containers enter said carrier and a top face from which said tops of said containers protrude from the plane of said carrier said cover being made of multilaterally-stretchable paper capable of stretching along two distinct axes said paper being attached to said bottom face of said carrier so that said tops of said containers thrust through said carrier from the bottom will be covered by said multilaterally-stretchable paper and retained in said carrier by said radial fingers bearing through said paper on the chimes under said tops of said containers.

8. A cover for tops of containers as in claim 7 wherein the attachment of the sheet of multilaterally-stretchable paper to the bottom of the carrier is strong enough to hold said sheet of paper to said carrier during handling but weak enough to release under the stress of insertion of said containers in said carrier.

9. A cover for tops of containers as in claim 7 wherein the sheet of multilaterally-stretchable paper has been during its production or later rendered moisture resistant.

10. A cover for tops of containers as in claim 7 wherein the sheet of multilaterally-stretchable paper is firmly attached to the bottom face of the carrier but only along the periphery of said carrier.

11. A cover for tops of containers as in claim 7 wherein the planar carrier has attached or hingedly connected thereto flaps, carrying handles, or other appurtanences which may not lie in the plane of said carrier.

* * * * *